US007804028B2

(12) United States Patent
Chin et al.

(10) Patent No.: US 7,804,028 B2
(45) Date of Patent: Sep. 28, 2010

(54) FLEXIBLE FLAT CABLE AND MANUFACTURING METHOD THEREOF

(75) Inventors: Yu Cheng Chin, Taoyuan (TW); Sheng Li Hung, Taoyuan (TW)

(73) Assignee: P-Two Industries Inc. (TW)

( * ) Notice: Subject to any disclaimer, the term of this patent is extended or adjusted under 35 U.S.C. 154(b) by 305 days.

(21) Appl. No.: 12/082,871

(22) Filed: Apr. 15, 2008

(65) Prior Publication Data

US 2009/0151980 A1 Jun. 18, 2009

(30) Foreign Application Priority Data

Dec. 14, 2007 (TW) ..... 96148341 A
Dec. 14, 2007 (TW) ..... 96221487 U

(51) Int. Cl.
*H01B 7/08* (2006.01)

(52) U.S. Cl. ..... 174/117 R; 174/117 F; 174/117 FF

(58) Field of Classification Search ..... 174/110 R, 174/113 R, 117 R, 117 F, 117 FF
See application file for complete search history.

(56) References Cited

U.S. PATENT DOCUMENTS 3,612,743 A * 10/1971 Angele et al. ..... 174/36
3,612,744 A * 10/1971 Thomas ..... 174/36
4,149,026 A * 4/1979 Fritz et al. ..... 174/32
4,652,772 A * 3/1987 Shephard ..... 307/147
4,678,864 A * 7/1987 Cox ..... 174/36
5,250,127 A * 10/1993 Hara ..... 156/52
6,635,827 B2 * 10/2003 Yosomiya ..... 174/117 F
7,399,929 B2 * 7/2008 Ueno et al. ..... 174/117 FF

* cited by examiner

*Primary Examiner*—William H Mayo, III
(74) *Attorney, Agent, or Firm*—Jackson Walker, LLP

(57) ABSTRACT

A flexible flat cable and a manufacturing method thereof are disclosed. The Flexible flat cable is manufactured by the following steps of: forming a metal layer on an insulated base layer, then forming a protective layer on the metal layer which had been formed above the insulated base layer, to make the metal layer be covered between the insulated base layer and the protective layer for forming a composite shelter, then preparing a conducting layer and an insulated substrate, and then spreading an insulated glue layer on the bottom of the composite shelter and then combining the composite shelter, the conducting layer and the insulated substrate by a thermo-compression bonding process to make the conducting layer be covered between the insulated base layer and the insulated substrate for forming a flexible flat cable having the composite shelter.

6 Claims, 6 Drawing Sheets

A-A

FLEXIBLE FLAT CABLE AND MANUFACTURING METHOD THEREOF

FIELD OF THE INVENTION

The present invention relates to a flexible flat cable and the manufacturing method thereof, and particularly to a method of manufacturing a flexible flat cable which has the shielding effect and matches the standard of characteristic impedance of electric connector, by simplified process and reduced cost.

BACKGROUND OF THE INVENTION

The flexile flat cable, FFC, is one kind of signal transmitting wire with high flexibility and high signal transmitting ability. Because of these advantages, the flexile flat cable has been applied in many electric products. When being applied, the flexile flat cable is usually coupled with an electric connector for transmitting a signal from one terminal to another terminal. The electric connector used in the low voltage differential signaling receiver, LVDS receiver, of the LCD displayer, has the characters such as high transmission speed, low power lost and low electromagnetic radiation, and such electric connector usually uses flexile flat cable as a transmission interface for transmitting signal stably.

In general, the inner structure of the flexible flat cable comprises a metal protective layer in which upper surface and lower surface are covered by insulated layers respectively. Two terminals of the metal layer are naked outside from the insulated layer for transmitting the signal. The flexible flat cable is cut into different sizes for application in different situations.

When the flexible flat cable is desired to match the standard of characteristic impedance of electric connector, the surface of the flexible flat cable must be printed with a metal-shielding layer with geometric pattern. After being dried by heat, the surface of metal-shielding layer is further printed with an insulated layer for protecting the metal-shielding layer.

Therefore, the conventional flexible flat cable must be performed by many processes such as printing, baking, re-printing and re-baking, for having the metal-shielding ability. Such manufacturing process takes much time, much manpower and is unsuitable for mass production. Besides, the size of the halftone applied for printing the metal layer is fixed, but size of the flexible flat cable varies for different application, so waste of material of metal-shielding layer may occur when such halftone is applied on the flexible flat cable with shorter size, and it leads to obvious increase of manufacturing cost in mass production.

In view of the drawbacks of the prior art, the inventor of the present invention based on years of experience in the related industry to conduct extensive researches and experiments, and finally developed a flexible flat cable and the manufacturing method thereof in accordance with the present invention to overcome the aforementioned drawbacks.

SUMMARY OF THE INVENTION

One objective of the present invention is to provide a flexible flat cable and the manufacturing method thereof. In the manufacturing method, a composite shelter is produced in advance, and composite shelter is then combined with the conducting layer and the insulated substrate by the thermo-compression bonding process for forming a flexible flat cable having the composite shelter. Therefore, the flexible flat cable of the present invention is provided with metal-shielding ability and matches the standard of characteristic impedance of electric connector.

One objective of the present invention is to provide a flexible flat cable and the manufacturing method thereof. In the method, a composite shelter is provided for making the flexible flat cable have metal-shielding ability by a wire combining process, and the process is further simplified and the cost is reduced.

The present invention relates to a flexible flat cable and the manufacturing method thereof. The method of manufacturing flexible flat cable comprises the steps of forming a metal layer on an insulated base layer by printing; forming a protective layer on the metal layer which had been formed above the insulated base layer to make the metal layer be covered between the insulated base layer and the protective layer for forming a composite shelter; preparing a an insulated substrate and conducting layer which is composed by arranging a plurality of conducting wire in spaced-apart order; spreading an insulated glue layer on outside of the insulated base layer of the composite shelter, and making the insulated glue layer to face the conducting layer, and combining the composite shelter, the conducting layer and the insulated substrate by the thermo-compression bonding process to make the conducting layer be covered between the insulated base layer and the insulated substrate for forming a flexible flat cable having the composite shelter. Therefore, the cost can be reduced, and the manufacturing process can be simplified, and the flexible flat cable has the shielding effect and matches the standard of characteristic impedance.

BRIEF DESCRIPTION OF THE DRAWINGS

The subject matter regarded as the invention is particularly pointed out and distinctly claimed in the concluding portion of the specification. The invention together with features and advantages thereof may best be understood by reference to the following detailed description with the accompanying drawings in which:

DETAILED DESCRIPTION OF THE PREFERRED EMBODIMENTS

Figure 1:
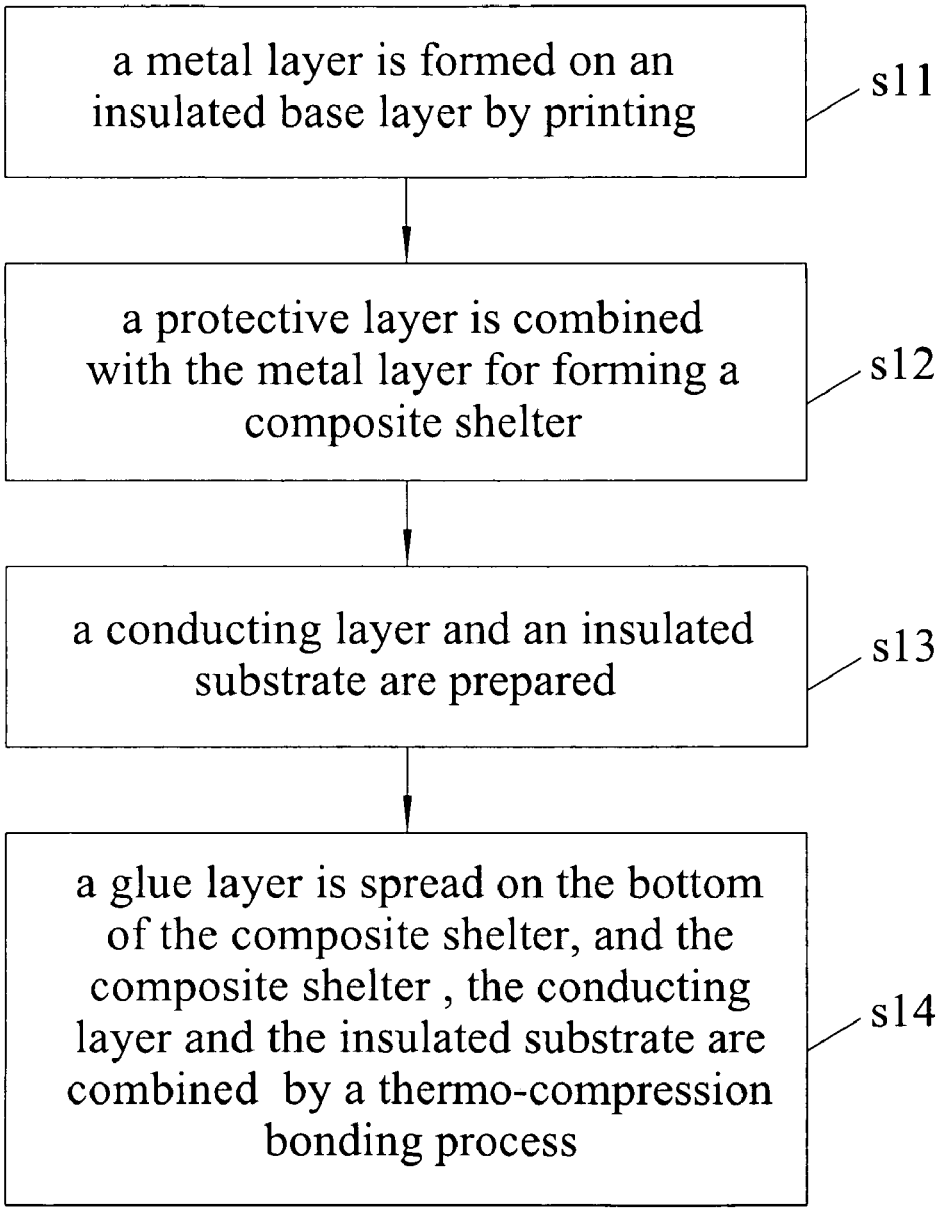
FIG. 1 is the flow diagram of method of manufacturing the flexible flat cable of the present invention.

To make it easier for our examiner to understand the objective of the invention, its structure, innovative features, and performance, we use preferred embodiments together with the attached drawings for the detailed description of the invention.

Pleases refer to FIG. 1~4 for the schematic views of the embodiments of the flexible flat cable and the manufacturing method thereof of the present invention. In step s11 a metal layer 12 is formed on an insulated base layer 11 by continuous printing. And in step s12 a protective layer 13 is combined with the metal layer 12 which has been formed above the insulated base layer 11 by a thermo-compression bonding process for forming a composite shelter 1. And then, in step 13 a conducting layer 2 and an insulated substrate 3 are prepared. The conducting layer 2 is composed by arranging a plurality of conducting wire 21 in spaced-apart order. In step 14 an insulated glue layer is spread on the bottom of the insulated base layer 11 of the composite shelter 1, and the insulated glue layer of the composite shelter 1 is then faced to the conducting layer 2. Finally, the composite shelter 1, the conducting layer 2 and the insulated substrate 3 are stacked and combined by a thermo-compression bonding process to form a flexible flat cable having the composite shelter 1.

Figure 2:
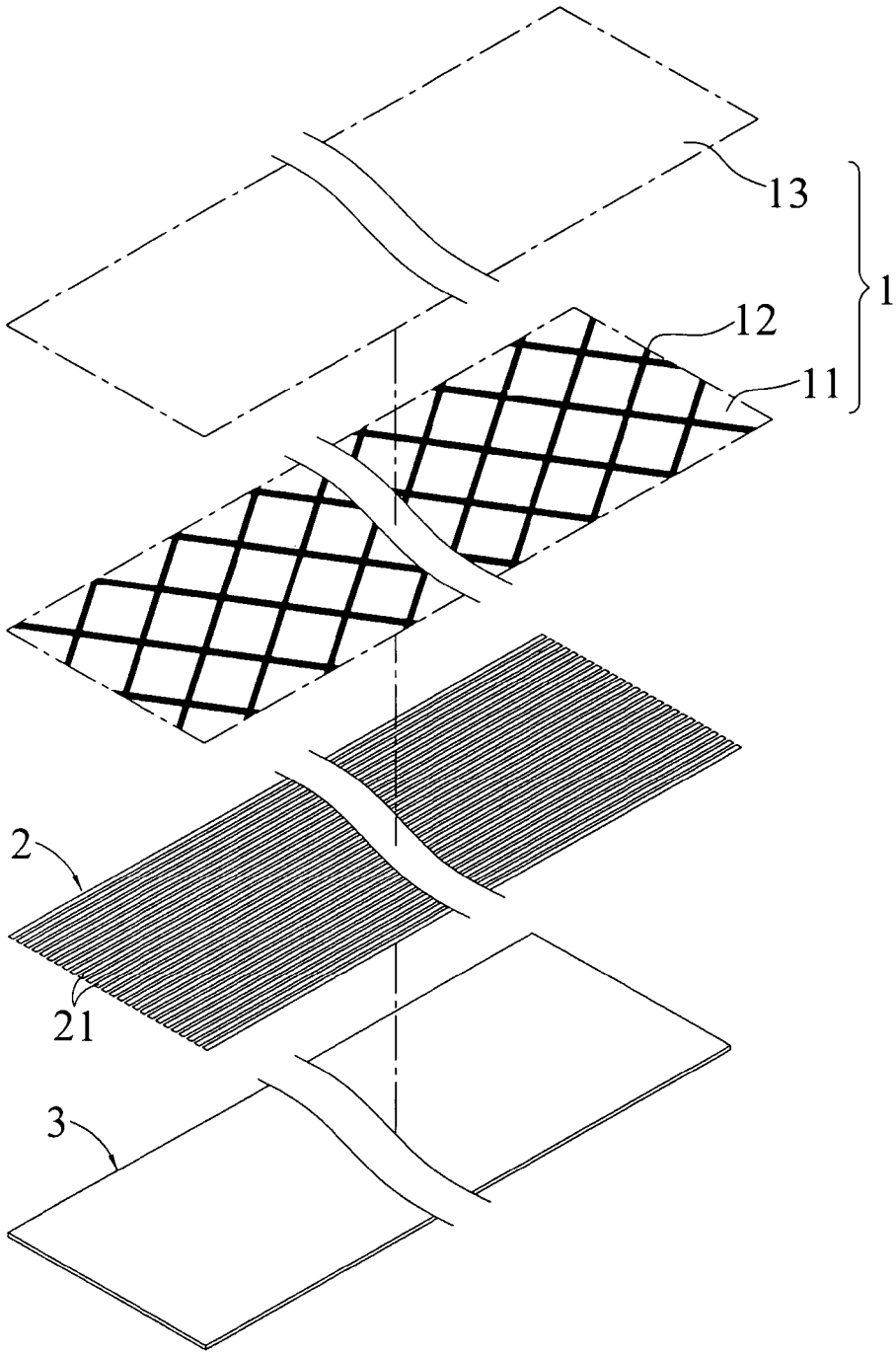
FIG. 2 is the exploded view of one embodiment of flexible flat cable of the present invention.
Figure 3:
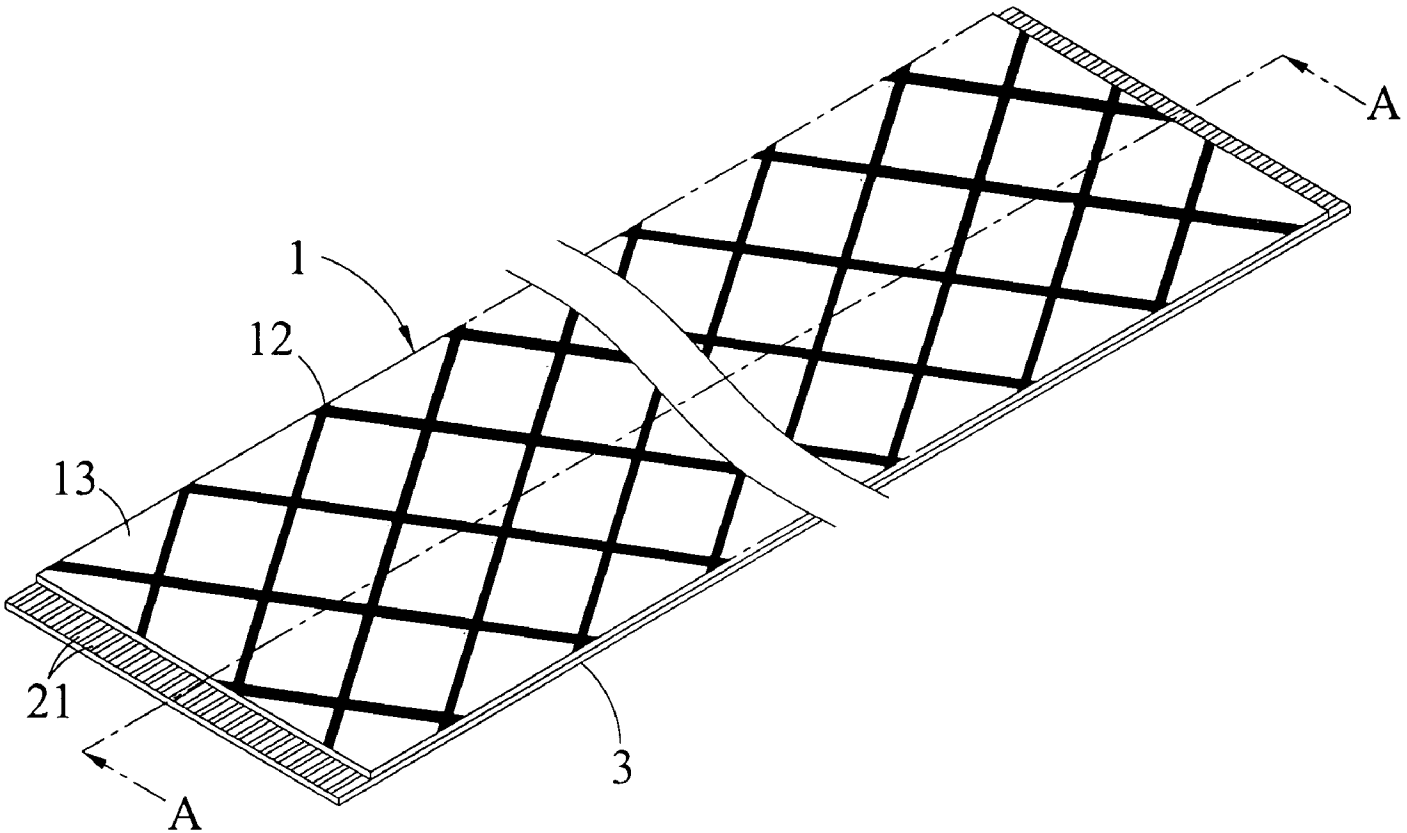
FIG. 3 is the exploded perspective view of one embodiment of flexible flat cable of the present invention.

As shown in FIG. 2 and FIG. 3, the metal layer 12 is arranged on the insulated base layer 11 in meshed arrangement. However, the type of the metal layer 12 does not limit in the meshed form, any geometric pattern arrangement or full covering of the metal layer 12 should be covered in the embodiment. The material of the insulated base layer 11 is preferred to be the polyester. Besides, a glue layer can be spread between the metal layer 12 and the protective layer 13 before combining the protective layer 13 by the thermo-compression bonding process, for tighter combination of the protective layer 13 and the metal layer 12.

Figure 4:
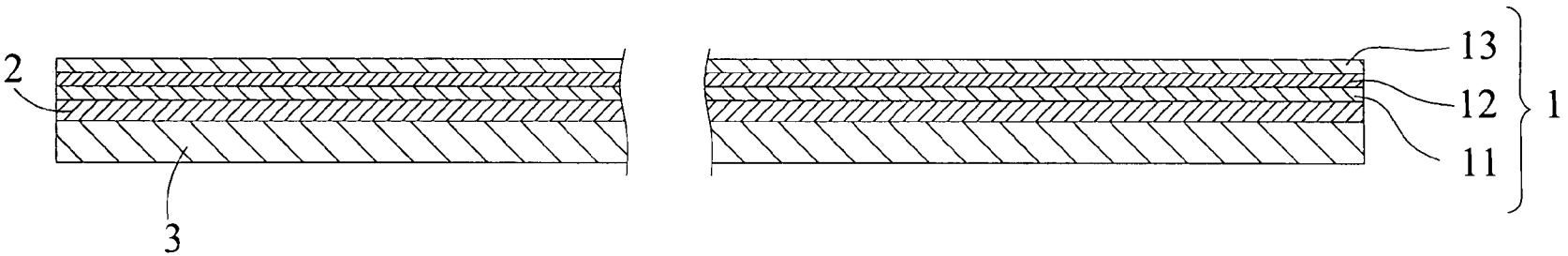
FIG. 4 is a cross-section view of the flexible flat cable in A-A section shown in FIG. 3 of the present invention.

As shown in FIG. 4, the composite shelter 1 of the embodiment is composed by stacking an insulated base layer 11, a metal layer 12 and a protective layer 13 from bottom to top. The thickness of the composite shelter 1 is substantially equal to that of the insulated substrate 3, so that the thickness of the shaped flexible flat cable will not change, and the conducting layer 2 is then covered between the composite shelter 1 and the insulated substrate 3 by the thermo-compression bonding process for forming a flexible flat cable which has high metal-shielding ability and matches the standard of characteristic impedance of electric connector. Such flexible flat cable can provide more smooth and stable inserting.

Figure 5:
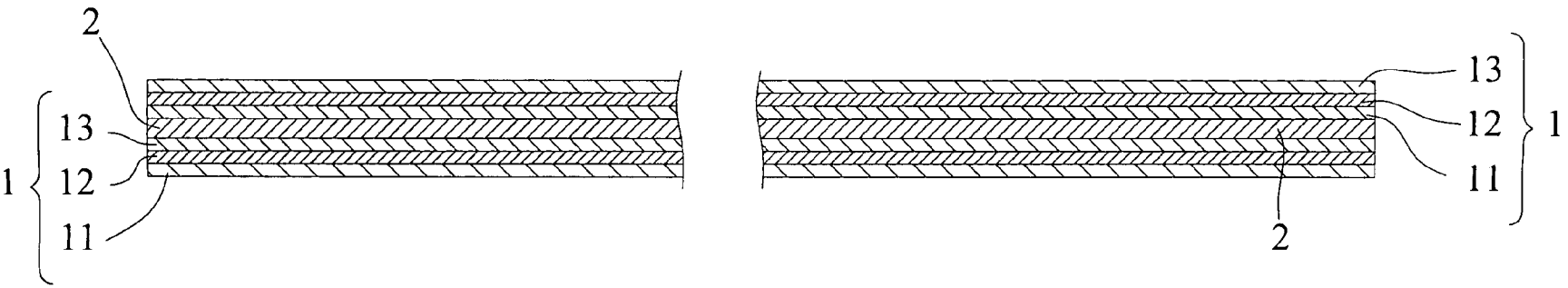
FIG. 5 is a cross-section view of another embodiment of the flexible flat cable of the present invention.

As shown in FIG. 5, both the top side and bottom side of the conducting layer 2 of the flexible flat cable of one embodiment can be covered by the composite shelter 1. It means that the insulated substrate 3 shown in FIG. 4 is replaced by the composite shelter 1, so that the composite shelters 1 are located around the flexible flat cable to provide a better metal-shielding effect.

Figure 6:
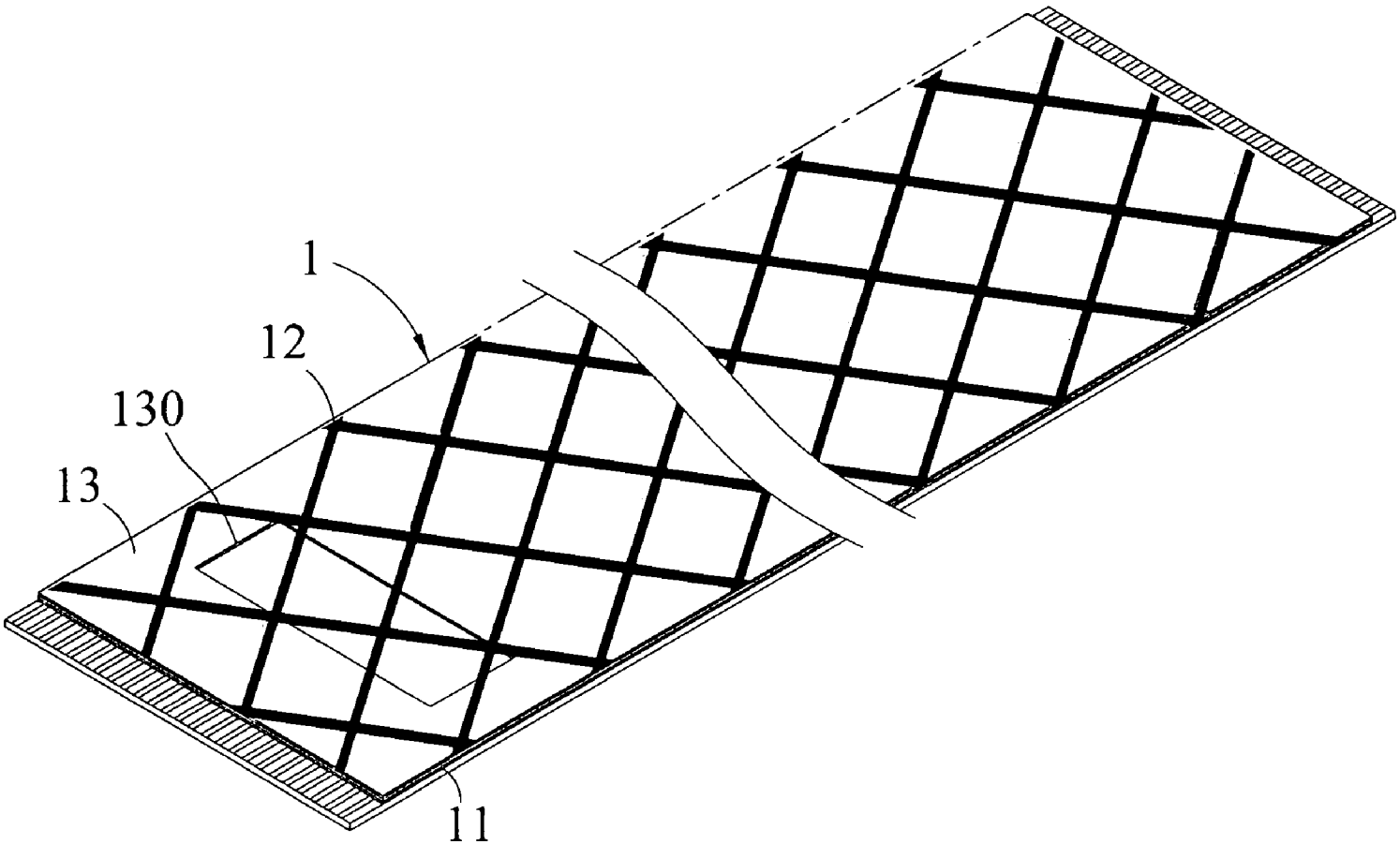
FIG. 6 is the exploded perspective view of the other embodiment of the flexible flat cable of the present invention.

The FIG. 6 illustrates another embodiment of the present invention. In this embodiment, the surface of the protective layer 13 of the composite shelter 1 is cut an opening 130 by the laser, and part of the protective layer 13 on the opening 130 is peeled, so that part of the metal layer 12 which under the protective layer 13 is naked thereby for connecting to other units, such as the metal shell, for the ground connecting.

In another embodiment of the present invention, the protective layer 13 is removed from the composite shelter 1. It means that an insulated glue layer is spread directly on the surface of the metal layer 12 without adding the protective layer 13 after the metal layer 12 is printed on the insulated base layer 11. And the insulated glue layer is then faced to the conducting layer 2, and combined with the conducting layer 2 and the insulated substrate 3 together by the thermo-compression bonding process. The embodiment mentioned above can manufacture the flexible flat cable with the same capability and simplify the manufacturing process.

In summary, the characteristic of the present invention is to print a metal layer on the insulated base layer continuously and further cover a protective layer for forming a composite shelter. And the bottom side of the composite shelter is spread a glue layer and further the composite shelter is stacked on the conducting layer and the insulated substrate. Finally, the composite shelter, the conducting layer and the insulated substrate are combined by the thermo-compression bonding process to form a flexible flat cable with metal-shielding ability. In the method of the present invention, many composite shelters can be produced in advance, and then the composite shelter, the conducting layer and the insulated substrate are combined for forming the flexible flat cable. Therefore, method of the present invention is suitable for mass production. Different sizes of the Flexible flat cables can be obtained by cutting the flexible flat cable produced by the method of the present invention. Comparing with the prior art, the present invention omits the processes such as printing, baking, re-printing and re-baking on cut flexible flat cable. Therefore, the present invention can simplify the process, reduces the cost and manufacture the flexible flat cable which has the shielding effect and matches the standard of characteristic impedance of electric connector.

While the present invention has been described by way of example and in terms of a preferred embodiment, it is to be understood that the present invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flexible flat cable composed by stacking a first composite shelter, a conducting layer and a second composite shelter, wherein said first composite shelter and said second composite shelter are composed by stacking an insulated base layer, a metal layer and a protective layer, and said conducting layer is composed by arranging a plurality of conducting wire in spaced-apart order.

2. A method of manufacturing flexible flat cable, comprising the steps of:

forming a metal layer on an insulated base layer;

forming a protective layer on said metal layer which had been formed above said insulated base layer, wherein said metal layer is covered between said insulated base layer and said protective layer for forming a first composite shelter;

preparing a conducting layer and a second composite shelter, and said conducting layer composed by arranging a plurality of conducting wires in spaced-apart order;

combining said first composite shelter, said conducting layer and said second composite shelter by a thermo-compression bonding process, and making said conducting layer be covered between said first composite shelter and said second composite shelter to form a flexible flat cable having said first composite shelter and said second composite shelter.

3. The method of claim 2, wherein said metal layer is formed on said insulated base layer in meshed arrangement by printing.

4. The method of claim 2, further comprising, before performing said thermo-compression bonding process, a step of:

spreading an insulated glue layer between said first composite shelter and said conducting layer.

5. The method of claim 2, further comprising, after performing said thermo-compression bonding process, a step of:

forming an opening on said protective layer by cutting for emerging said metal layer.

6. A method of manufacturing flexible flat cable, comprising the steps of:

forming a metal layer on an insulated base layer by printing;

forming an insulated glue layer on said metal layer which had been formed on said insulated base layer, wherein said metal layer is covered between said insulated base layer and said insulated glue layer to form a first composite shelter;

preparing a second composite shelter and a conducting layer which is composed by arranging a plurality of conducting wire in spaced-apart order;

making said insulated glue layer to face said conducting layer, and combining said first composite shelter, said conducting layer and said second composite shelter by a thermo-compression bonding process to make said conducting layer be covered between said insulated glue layer and said second composite shelter for forming a flexible flat cable having said first composite shelter and said second composite shelter.

* * * * *